US006926393B2

(12) United States Patent
Yonekubo

(10) Patent No.: US 6,926,393 B2
(45) Date of Patent: Aug. 9, 2005

(54) LIQUID JETTING HEAD

(75) Inventor: Shuji Yonekubo, Nagano-Ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 10/406,568

(22) Filed: Apr. 4, 2003

(65) Prior Publication Data

US 2003/0214560 A1 Nov. 20, 2003

(30) Foreign Application Priority Data

Apr. 5, 2002 (JP) ..... 2002-104285

(51) Int. Cl.[7] ..... B41J 2/045
(52) U.S. Cl. ..... 347/68
(58) Field of Search ..... 347/68–72

(56) References Cited

U.S. PATENT DOCUMENTS

| | | | | |
|---|---|---|---|---|
| 4,788,557 A | * | 11/1988 | Howkins | 347/68 |
| 5,379,060 A | * | 1/1995 | Yoshimura | 347/71 |
| 6,296,351 B1 | * | 10/2001 | Tanaka et al. | 347/68 |
| 6,481,834 B2 | | 11/2002 | Takahashi et al. | 347/68 |
| 6,499,836 B1 | | 12/2002 | Usui et al. | |
| 6,557,985 B2 | | 5/2003 | Hosono et al. | 347/68 |

FOREIGN PATENT DOCUMENTS

| | | |
|---|---|---|
| JP | 56-136371 | 10/1981 |
| JP | 61-100469 | 5/1986 |
| JP | 1-210353 A | 8/1989 |
| JP | 08-058086 | 3/1996 |
| JP | 2000-263799 A | 9/2000 |
| JP | 2001-277496 A | 10/2001 |
| JP | 2001-353871 A | 12/2001 |

* cited by examiner

*Primary Examiner*—Thinh Nguyen
*Assistant Examiner*—Julian D. Huffman
(74) *Attorney, Agent, or Firm*—Sughrue Mion, PLLC

(57) ABSTRACT

A liquid jetting head of the invention includes a nozzle plate having a plurality of nozzles and a flowing-path plate layered on the nozzle plate. The flowing-path plate has a plurality of nozzle-communicating chambers and a plurality of elongated pressure-chambers. The plurality of nozzle-communicating chambers respectively communicate with the plurality of nozzles, the plurality of pressure-chambers respectively communicate with the plurality of nozzle-communicating chambers, and the plurality of pressure-chambers are open to a side away from the nozzle plate. A vibrating plate commonly seals the open surfaces of the plurality of pressure-chambers of the flowing-path plate, and a plurality of pressure-generating units respectively changes pressures of liquid in the respective pressure-chambers. The plurality of nozzles are aligned on a line segment, and at least one of the pressure-chambers communicating with at least one of the nozzles in the vicinity of an end of the line segment is formed so as to have a shorter length than at least one of the pressure-chambers communicating with at least one of the nozzles away from the end of the line segment.

7 Claims, 6 Drawing Sheets

LIQUID JETTING HEAD

FIELD OF THE INVENTION

This invention is related to a liquid jetting head that jets a drop of liquid from a nozzle by increasing a pressure of liquid in a pressure-chamber by means of a pressure-generating unit.

BACKGROUND OF THE INVENTION

In an ink-jetting recording head, which is an example of a liquid jetting head, a plurality of pressure-chambers are formed in the same substrate into one or more rows so as to communicate with respective independent nozzles and a common ink-chamber. A drop of ink can be jetted from a nozzle when the volume of a pressure-chamber corresponding to the nozzle is changed by a piezoelectric vibrating member and so on, or when the ink in the pressure-chamber is vapored by a heating element.

The pressure-chambers of the ink-jetting recording head have to be formed at regular intervals (pitches) corresponding to desired recording density. Thus, the pressure-chambers are formed by an etching process of a metal substrate or by an injection molding of a polymer material.

In order to ensure a high etching accuracy, it is effective to conduct an anisotropic etching process by using a silicon single crystal as a substrate material. However, in the case, there is a problem of increase of material cost.

On the other hand, in a case wherein an injection molding of a polymer material is conducted, the pressure-chambers can be relatively easily formed with higher accuracy. However, no polymer material has high rigidity, so that the pressure-chambers formed therein tend to be deteriorated by means of driving of the piezoelectric vibrating members or heat generation of the heating elements.

In order to solve the above problems, an invention described in Japanese Patent Laid-Open Publication No. 2000-263799, which was filed by the applicant, provides an ink-jetting recording head superior in durability and manufacturing cost.

In the invention disclosed in the above gazette, as shown in FIG. 10, a flowing-path unit is formed by layering: a nozzle plate 103 through which a plurality of nozzles 102 are formed; a flowing-path substrate 108 having a plurality of pressure-chambers 105 communicating with the plurality of nozzles 102, a reservoir 107 for supplying ink through a plurality of ink-supplying ports 106 to the plurality of pressure-chambers 105, a first surface 108*a* and a second surface 108*b* opposite to the first surface 108*a*; and a lid plate 111 that seals the first surface 108*a* of the flowing-path substrate 108. A piezoelectric vibrating member is provided to increase a pressure of the ink in each pressure chamber 105. A through hole that becomes the reservoir 107 is formed through a metal plate having the first surface 108*a* and the second surface 108*b*, that is, from the surface 108*a* to the second surface 108*b*. Then, a plurality of concave portions that become the plurality of pressure-chambers 105 are formed on the first surface 108*a* of the metal plate by a press working, so that the flowing-path substrate 108 is formed.

According to the invention disclosed in the gazette of Japanese Patent Laid-Open Publication No. 2000-263799, the flowing-path substrate 108 is formed by a press working from a metal plate such as a nickel plate or the like, which is superior in extensibility. This working way is simple and cheap.

FIG. 1 shows an electric circuit equivalent to an ink-jetting recording head. In FIG. 1, m[kg/m$^4$] represents inertance, c[m$^5$/N] represents acoustic capacitance, r[Ns/m$^5$] represents acoustic resistance, and U[m$^3$/s] represents volume velocity. Regarding indices thereof, the index "0" means a vibrating member system including a piezoelectric member (laminated PZT) and a vibrating plate connected thereto, the index "1" means an ink pressure-chamber system, the index "2" means an ink supplying flowing-path system, and the index "3" means a nozzle flowing-path system. The contents of the brackets [ ] represent respective units.

When the equivalent electric circuit is broken up, a circuit including only the vibrating member system shown in FIG. 2 can be extracted. The circuit has a natural period depend on the vibrating member, which may be represented by the following expression.

$$T_a=2\pi\sqrt{m_0c_0} \tag{1}$$

In addition, when the equivalent electric circuit shown in FIG. 1 is broken up, a circuit consisting of the ink pressure-chamber system, the ink supplying flowing-path system and the nozzle flowing-path system can be extracted, as shown in FIG. 3. In the circuit, as viewed from the ink pressure-chamber, the nozzle flowing-path system and the ink supplying flowing-path system are connected in parallel. In addition, the circuit has a natural period of the ink flowing-path system, which may be dominated by the acoustic capacitance of the ink pressure-chamber and may be represented by the following expression.

$$T_c = 2\pi\sqrt{\frac{m_2 \cdot m_3}{m_2 + m_3}\, c_1} \tag{2}$$

In addition, when the equivalent electric circuit shown in FIG. 1 is broken up, a series circuit consisting of the nozzle flowing-path system and the ink supplying flowing-path system can be extracted, as shown in FIG. 4. The circuit has a natural period of the ink flowing-path system, which may be dominated by the acoustic capacitance by surface tension of an ink meniscus formed in the nozzle and may be represented by the following expression.

$$T_m=2\pi\sqrt{(m_{2+m_3})c_3} \tag{3}$$

Herein, the above natural periods are different and away from each other, and the following expression is satisfied.

$$T_a<T_c<T_m \tag{4}$$

In addition, the inertance m of the ink flowing-path system is calculated by the following expression.

$$m = \kappa\int\frac{\rho}{S}dx \tag{5}$$

Herein, ρ represents an ink density, S represents a sectional area of the flowing-path perpendicular to a flowing direction of the ink, x represents a coordinate in the flowing direction, and κ is a coefficient depend on a vibration (oscillation) frequency of the ink flow. For example, the value of κ is 1.4.

It is preferable that ink-jetting control of an ink-jetting recording apparatus is conducted to a plurality of nozzles in a common manner. For that purpose, it is requested that characteristics of the plurality of nozzles, in particular frequency response characteristics of the plurality of nozzles, coincide with each other.

In general, ink is supplied from a common ink chamber to a plurality of pressure-chambers respectively communicating with a plurality of nozzles. If the plurality of nozzles are aligned on a line segment, a substantial sectional area S of an ink flowing-path from the common ink chamber to a pressure-chamber communicating with a nozzle in the vicinity of an end of the line segment is smaller than a substantial sectional area S of an ink flowing-path from the common ink chamber to a pressure-chamber communicating with a central nozzle away from the end of the line segment, because of effect of an end wall of the ink chamber. Thus, characteristics of the plurality of nozzles formed on the line segment may be different. In detail, the characteristic of a nozzle in the vicinity of the end of the line segment and the characteristic of a central nozzle away from the end of the line segment may be different.

In addition, the common ink chamber is usually formed into a tapered shape, in which a flowing-path width thereof is positively tapered, in an area in the vicinity of the end wall, in order to raise a flowing speed of the ink to prevent air bubbles from remaining when the ink is supplied (filled) or when the ink is sucked for a cleaning operation. In the case, a substantial sectional area S of an ink flowing-path from the common ink chamber to a pressure-chamber communicating with a nozzle in the vicinity of an end of the line segment becomes further smaller than a substantial sectional area S of an ink flowing-path from the common ink chamber to a pressure-chamber communicating with a central nozzle away from the end of the line segment. This may increase the possibility that the characteristic of a nozzle in the vicinity of the end of the line segment and the characteristic of a central nozzle away from the end of the line segment be different.

SUMMARY OF THE INVENTION

The object of this invention is to solve the above problems, that is, to provide a liquid jetting head such as an ink-jet recording head wherein a plurality of nozzles are formed on a line segment and wherein frequency response characteristics of the plurality of nozzles substantially coincide with each other.

In order to achieve the object, a liquid jetting head includes: a nozzle plate having a plurality of nozzles; a flowing-path plate layered on the nozzle plate, the flowing-path plate having a plurality of nozzle-communicating chambers and a plurality of elongated pressure-chambers, the plurality of nozzle-communicating chambers respectively communicating with the plurality of nozzles, the plurality of pressure-chambers respectively communicating with the plurality of nozzle-communicating chambers, the plurality of pressure-chambers being open to a side away from the nozzle plate; a vibrating plate commonly sealing the open surfaces of the plurality of pressure-chambers of the flowing-path plate; a plurality of pressure-generating units that respectively changes pressures of liquid in the respective pressure-chambers; wherein the plurality of nozzles are aligned on a line segment; and at least one of the pressure-chambers communicating with at least one of the nozzles in the vicinity of an end of the line segment is formed so as to have a shorter length than at least one of the pressure-chambers communicating with at least one of the nozzles away from the end of the line segment (at least one central nozzle).

According to the feature, since the at least one of the pressure-chambers communicating with the at least one of the nozzles in the vicinity of the end of the line segment is formed so as to have a shorter length than the at least one of the pressure-chambers communicating with the at least one of the nozzles away from the end of the line segment, the inertance of at least one liquid flowing-path system communicating with the at least one of the nozzles in the vicinity of the end of the line segment, which tends to become larger in prior art, can be adjusted to coincide with the inertance of at least one liquid flowing-path system communicating with the at least one of the nozzles away from the end of the line segment.

Preferably, at least two of the pressure-chambers communicating with at least two of the nozzles in the vicinity of the end of the line segment are formed so as to have shorter lengths in order toward the end of the line segment.

In the case, the respective inertance of at least two liquid flowing-path systems communicating with the at least two of the nozzles in the vicinity of the end of the line segment can be adjusted more suitably to coincide with the inertance of at least one liquid flowing-path system communicating with the at least one of the nozzles away from the end of the line segment, while the respective degrees of tendencies that the respective inertance of the respective liquid flowing-path systems become larger are taken into consideration.

In general, each of the pressure-chambers is formed in a direction substantially perpendicular to the line segment on which the plurality of nozzles are aligned.

Preferably, the vibrating plate has a plurality of supplying ports that respectively communicate with the plurality of pressure-chambers, and each of the supplying ports is arranged at a position that corresponds to a length of each of the pressure-chambers communicating with the supplying port, for example at a position away from an one-side end of each of the pressure-chambers in a longitudinal direction thereof by a predetermined distance.

In the case, preferably, a common liquid-chamber commonly communicates with the plurality of supplying ports. The common liquid-chamber may be formed by a common-liquid-chamber member above the vibrating plate.

Preferably, the common liquid-chamber has a shape tapered toward the end of the line segment on which the plurality of nozzles are aligned. In the case, a flowing speed of the liquid is raised, so that it can be effectively prevented that air bubbles remain in the common liquid-chamber, when the liquid is filled or the like.

In addition, this invention is a liquid jetting head including: a nozzle plate having a plurality of nozzles; a flowing-path plate layered on the nozzle plate, the flowing-path plate having a plurality of nozzle-communicating chambers and a plurality of pressure-chambers, the plurality of nozzle-communicating chambers respectively communicating with the plurality of nozzles, the plurality of pressure-chambers respectively communicating with the plurality of nozzle-communicating chambers, the plurality of pressure-chambers being open to a side away from the nozzle plate; a vibrating plate commonly sealing the open surfaces of the plurality of pressure-chambers of the flowing-path plate; a plurality of pressure-generating units that respectively changes pressures of liquid in the respective pressure-chambers; wherein the plurality of nozzles are aligned on a line segment; the vibrating plate has a plurality of supplying ports that respectively communicate with the plurality of pressure-chambers; and at least one of the supplying ports communicating with at least one of the nozzles in the vicinity of an end of the line segment is formed so as to have a larger diameter than at least one of the supplying ports communicating with at least one of the nozzles away from the end of the line segment.

According to the feature, since the at least one of the supplying ports communicating with the at least one of the nozzles in the vicinity of the end of the line segment is formed so as to have a larger diameter than the at least one of the supplying ports communicating with the at least one of the nozzles away from the end of the line segment, the inertance of at least one liquid flowing-path system communicating with the at least one of the nozzles in the vicinity of the end of the line segment, which tends to become larger in prior art, can be adjusted to coincide with the inertance of at least one liquid flowing-path system communicating with the at least one of the nozzles away from the end of the line segment.

Preferably, at least two of the supplying ports communicating with at least two of the nozzles in the vicinity of the end of the line segment are formed so as to have larger diameters in order toward the end of the line segment.

In the case, the respective inertance of at least two liquid flowing-path systems communicating with the at least two of the nozzles in the vicinity of the end of the line segment can be adjusted more suitably to coincide with the inertance of at least one liquid flowing-path system communicating with the at least one of the nozzles away from the end of the line segment, while the respective degrees of tendencies that the respective inertance of the respective liquid flowing-path systems become larger are taken into consideration.

In addition, this invention is a liquid jetting head including: a nozzle plate having a plurality of nozzles; a flowing-path plate layered on the nozzle plate, the flowing-path plate having a plurality of nozzle-communicating chambers and a plurality of pressure-chambers, the plurality of nozzle-communicating chambers respectively communicating with the plurality of nozzles, the plurality of pressure-chambers respectively communicating with the plurality of nozzle-communicating chambers, the plurality of pressure-chambers being open to a side away from the nozzle plate; a vibrating plate commonly sealing the open surfaces of the plurality of pressure-chambers of the flowing-path plate; a plurality of pressure-generating units that respectively changes pressures of liquid in the respective pressure-chambers; wherein the plurality of nozzles are aligned on a line segment; the vibrating plate has a plurality of thin-parts, each of which is formed in at least a portion in an area corresponding to each of the open surfaces of the plurality of pressure-chambers; and at least one of the thin-parts corresponding to at least one of the pressure-chambers communicating with at least one of the nozzles in the vicinity of an end of the line segment is formed so as to have a smaller area than at least one of the thin-parts corresponding to at least one of the pressure-chambers communicating with at least one of the nozzles away from the end of the line segment.

According to the feature, since the at least one of the thin-parts corresponding to the at least one of the pressure-chambers communicating with the at least one of the nozzles in the vicinity of the end of the line segment is formed so as to have a smaller area than the at least one of the thin-parts corresponding to the at least one of the pressure-chambers communicating with the at least one of the nozzles away from the end of the line segment, acoustic capacitance of the respective pressure-chambers can be adjusted, so that the natural period Tc of at least one liquid flowing-path system communicating with the at least one of the nozzles in the vicinity of the end of the line segment can be directly adjusted to coincide with the natural period Tc of at least one liquid flowing-path system communicating with the at least one of the nozzles away from the end of the line segment.

Preferably, at least two of the thin-parts corresponding to at least two of the pressure-chambers communicating with at least two of the nozzles in the vicinity of the end of the line segment are formed so as to have smaller areas in order toward the end of the line segment.

In the case, the respective natural periods Tc of at least two liquid flowing-path systems communicating with the at least two of the nozzles in the vicinity of the end of the line segment can be adjusted more suitably to coincide with the natural period Tc of at least one liquid flowing-path system communicating with the at least one of the nozzles away from the end of the line segment, while the respective degrees of tendencies that the respective inertance of the respective liquid flowing-path systems communicating with the at least two of the nozzles in the vicinity of the end of the line segment become larger are taken into consideration.

In general, each of the plurality of pressure-generating units has a piezoelectric vibrating member fixed on the vibrating plate in a substantially central portion of an area corresponding to each of the open surfaces of the plurality of pressure-chambers, and each of the plurality of thin-parts is formed to surround each of the fixed plurality of piezoelectric vibrating members.

Preferably, each of the pressure-chambers is formed in an elongated shape in a direction substantially perpendicular to the line segment on which the plurality of nozzles are aligned.

In addition, preferably, at least one of the thin-parts corresponding to at least one of the pressure-chambers communicating with at least one of the nozzles in the vicinity of the end of the line segment is formed so as to have a shorter length in a direction substantially perpendicular to the line segment than at least one of the thin-parts corresponding to at least one of the pressure-chambers communicating with at least one of the nozzles away from the end of the line segment.

More preferably, at least two of the thin-parts corresponding to at least two of the pressure-chambers communicating with at least two of the nozzles in the vicinity of the end of the line segment are formed so as to have shorter lengths in the direction substantially perpendicular to the line segment in order toward the end of the line segment.

In the above structure, the flowing-path plate may consist of a metal plate that can be processed by a press working. In the case, the plurality of pressure-chambers or the like can be easily formed in the flowing-path substrate by means of a press working.

In addition, this invention is a liquid jetting apparatus including: a liquid jetting head having at least one of the above features; and a controller that respectively controls the plurality of pressure-generating units.

BEST MODE FOR CARRYING OUT THE INVENTION

Embodiments of the invention will now be described in more detail with reference to drawings.

Figure 1:
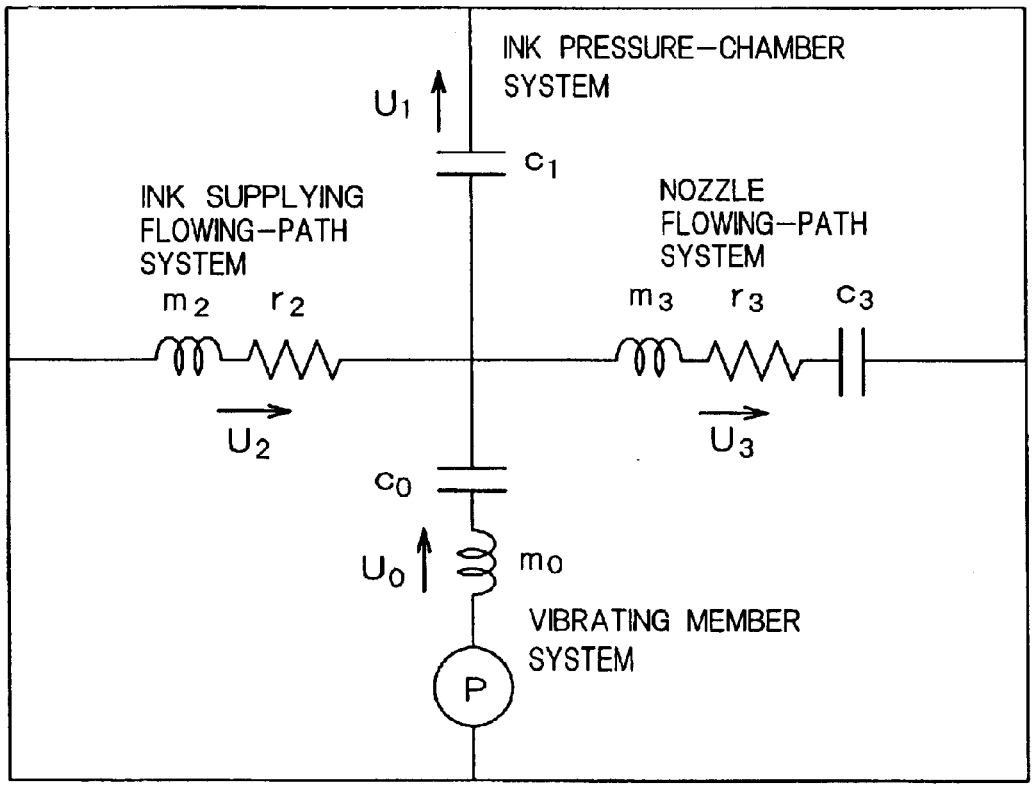
FIG. 1 is a block diagram showing an electric circuit equivalent to an ink-jetting recording apparatus.
Figure 2:
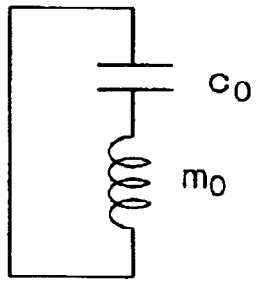
FIG. 2 is a block diagram showing an electric circuit consisting of the vibrating member system, which can be extracted from the equivalent electric circuit shown in FIG. 1.
Figure 3:
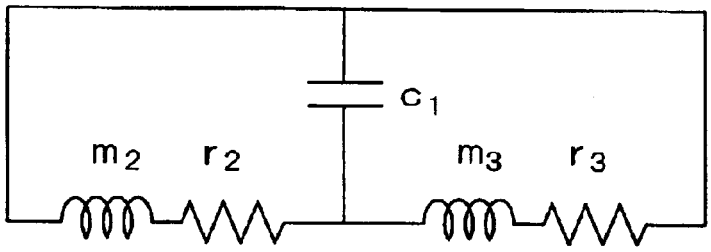
FIG. 3 is a block diagram showing an electric circuit consisting of the ink pressure-chamber system, the nozzle flowing-path system and the ink supplying flowing-path system, which can be extracted from the equivalent electric circuit shown in FIG. 1.
Figure 4:
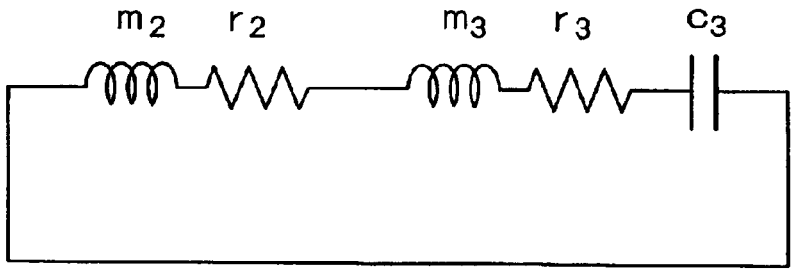
FIG. 4 is a block diagram showing an electric circuit consisting of the nozzle flowing-path system and the ink supplying flowing-path system, which can be extracted from the equivalent electric circuit shown in FIG. 1.
Figure 5:
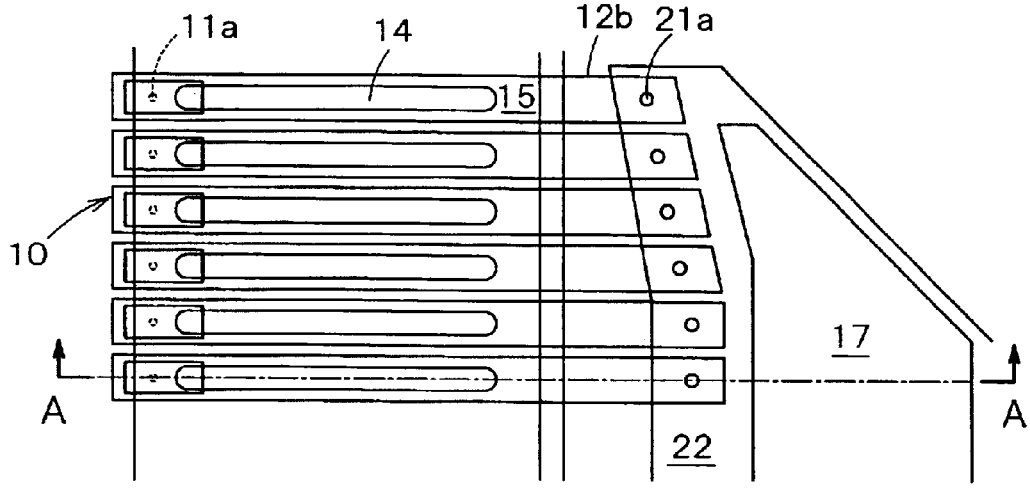
FIG. 5 is a schematic plan view of an ink-jetting recording head of a first embodiment according to the invention.
Figure 6:
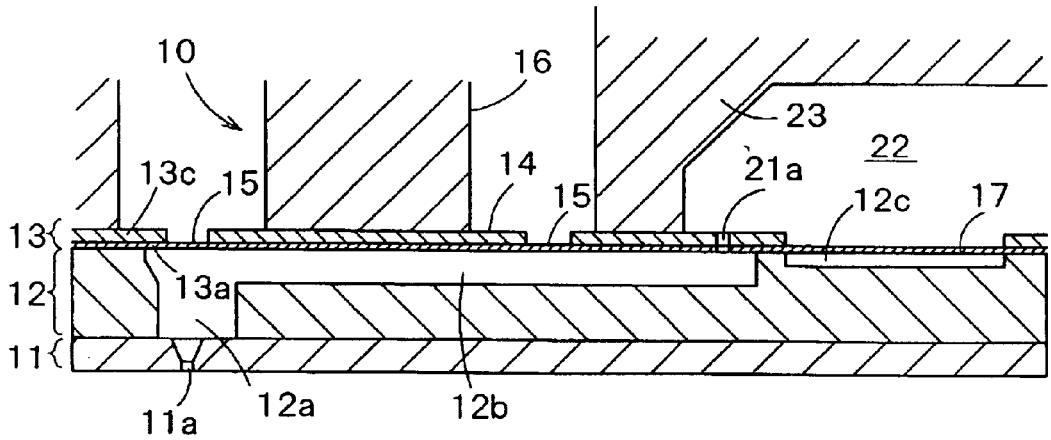
FIG. 6 is a schematic sectional view taken along A—A line of FIG. 5.

FIG. 5 is a schematic plan view of an ink-jetting recording head, which is a first embodiment of an liquid jetting head according to the invention. FIG. 6 is a schematic longitudinal sectional view taken along A—A line of FIG. 5. As shown in FIGS. 5 and 6, the ink-jetting recording head 10 of the first embodiment includes a nozzle plate 11 through which a plurality of nozzles 11*a* are formed on one row.

A flowing-path plate 12 is adhesively layered on the nozzle plate 11. A plurality of nozzle-communicating chambers 12*a* that respectively communicate with the plurality of nozzles 11*a* are formed in the flowing-path plate 12. In addition, a plurality of pressure-chambers 12*b* that respectively communicate with the plurality of nozzle-communicating chambers 12*a* are formed in the flowing-path plate 12. The plurality of pressure-chambers 12*b* are open to a side away from the nozzle plate 11. Each of the pressure-chambers 12*b* is formed in an elongated shape in a direction substantially perpendicular to a line segment on which the plurality of nozzles 11*a* are aligned. Each nozzle 11*a* and each nozzle-communicating chamber 12*a* are arranged at a one-side end portion of each elongated pressure-chamber 12*b*.

A flowing-path plate 12 of the embodiment is made from a nickel plate, which is a metal plate that can be processed by a press working. The plurality of nozzle-communicating chambers 12*a* and the plurality of pressure-chambers 12*b* are formed by a press working. A method of manufacturing the flowing-path plate 12 is explained in detail later.

Open surfaces of the plurality of pressure-chambers 12*b* of the flowing-path plate 12 are sealed by a vibrating plate 13. The vibrating plate 13 commonly seals the respective open surfaces.

Specifically, the vibrating plate 13 has a double-layer structure, which consists of a main layer 13*a* made of a resin film and a metal layer 13*c* mounted on the main layer 13*a* via an adhesive layer. The main layer 13*a* is arranged on the open surfaces of the pressure chambers 12*b*.

In the case, the metal layer 13*c* is made of SUS. On the other hand, the main layer 13*a* is made of PPS.

An island portion 14 is formed at the metal layer 13*c* on a side away from the open surfaces of the pressure-chambers 12*b*, in a substantially central portion of an area corresponding to each of the open surfaces of the pressure-chambers 12*b*. In the case, a thin-part 15 is formed around the island portion 14 through the metal layer 13*c*. It is preferable that the island portion 14 (and the thin-part 15 around the island portion 14) is formed by an etching process. As shown in FIG. 5, in the first embodiment, the respective island portions 14 have the same shape, and the respective thin-parts 15 have the same shape.

A laminated PZT 16 is joined on the island portion 14. The laminated PZT 16 serves as a pressure-generating unit that changes a pressure of the ink (liquid) in each pressure chamber 12*b*.

In addition, as shown in FIG. 6, a plurality of ink supplying ports 21*a* that respectively communicate with the plurality of pressure-chambers 12*b* are formed in the vibrating plate 13. Each ink supplying port 21*a* is arranged at the opposite-side end portion of each elongated pressure-chamber 12*b*, which is explained in detail later.

The respective ink supplying ports 21*a* commonly communicate with a common ink chamber 22 that is formed above the vibrating plate 13. The common ink chamber 22 is defined by a upper surface of the vibrating plate 13 and a common-ink-chamber forming plate 23 hermetically fixed on the vibrating plate 13.

A portion of the vibrating plate 13 defining the common ink chamber 22 forms a thin-part 17, from which the metal layer 13*c* has been removed through. In addition, a void 12*c* is formed in a portion of the flowing-path plate 12 corresponding to the thin-part 17, in order to allow a vertical deformation of the thin-part 17. The void 12*c* also may be formed by a press working.

As shown in FIG. 5, the common ink chamber 22 of the first embodiment has a shape tapered toward the end of the line segment on which the plurality of nozzles 11*a* are aligned.

The tapered shape of the common ink chamber 22 is effective to raise the flowing speed of the supplied ink, and hence to prevent air bubbles from remaining in the common ink chamber 22 or the like when the ink is filled or when the ink is sucked.

However, in a tapered area (in the vicinity of the end of the line segment), a substantial sectional area of the ink flowing-path is smaller. Thus, the inertance of an ink flowing-path system communicating with a nozzle 11*a* in the vicinity of the end of the line segment is larger. Therefore, there is a possibility that the characteristic of a nozzle 11*a* in the vicinity of the end of the line segment and the characteristic of another nozzle 11*a* away from the end (both ends) of the line segment might be different.

In order to remove the possibility, according to the embodiment, several (at least one) pressure-chambers 12*b* communicating with several (at least one) nozzles 11*a* in the vicinity of the end of the line segment are formed so as to have shorter lengths than a pressure-chamber 12*b* communicating with a central nozzle 11*a* away from the end (both ends) of the line segment.

Specifically, as shown in FIG. 5, the respective lengths of four pressure-chambers 12*b* communicating with four nozzles 11*a* in the vicinity of the end of the line segment are gradually shorter in order toward the end of the row of the nozzles 11*a* (line segment).

In this case, end portions of the pressure-chambers 12*b* on the side of the nozzles 11*a* are aligned in parallel with the line segment on which the nozzles 11*a* is aligned. That is, opposite end portions of the pressure-chambers 12*b* on the side of the ink supplying ports 21*a* are stepwise located toward the end of the row of the nozzles 11*a*.

Specifically, pressure-chambers 12*b* communicating with nozzles 11*a* in a central portion of the row of the nozzles 11*a* have a length of about 1.4 mm, a depth of about 0.1 mm, and a width of about 0.11 mm. The pressure-chamber 12*b* communicating with the nozzle 11*a* in the close vicinity of (located at) the end of the row of the nozzles 11*a* has a length shorter than the pressure-chambers 12*b* communicating with the nozzles 11*a* in the central portion by 0.20 mm. The pressure-chamber 12*b* communicating with the nozzle 11*a* in the second close vicinity of the end of the row of the nozzles 11*a* has a length shorter than the pressure-chambers 12*b* communicating with the nozzles 11*a* in the central portion by 0.15 mm. The pressure-chamber 12*b* communicating with the nozzle 11*a* in the third close vicinity of the end of the row of the nozzles 11*a* has a length shorter than the pressure-chambers 12*b* communicating with the nozzles 11*a* in the central portion by 0.10 mm. The pressure-chamber 12*b* communicating with the nozzle 11*a* in the fourth close vicinity of the end of the row of the nozzles 11*a* has a length shorter than the pressure-chambers 12*b* communicating with the nozzles 11*a* in the central portion by 0.05 mm.

In addition, as shown in FIG. 5, each of the ink supplying ports 21*a* is arranged at a position that corresponds to a length of each of the pressure-chambers 12*b* communicating with the ink supplying port. In this case, each of the ink supplying ports 21*a* is arranged at a position away by a predetermined distance from the end of each of the pressure-chambers 12*b* away from the nozzle 11*a*. That is, the positions of four ink supplying ports 21*a* communicating with the four nozzles 11*a* in the vicinity of the end of the row of the nozzles 11*a* are located stepwise by 0.05 mm, in order toward the end of the row of the nozzles 11*a*.

Herein, as shown in FIG. 5, the common ink chamber 22 of the first embodiment juts out toward the nozzles 11*a*, in an area in the vicinity of the end of the row of the nozzles 11*a*. In addition, the thin-part 17 of the common ink chamber 22 also juts out toward the nozzles 11*a*, in an area in the vicinity of the end of the row of the nozzles 11*a*. This arrangement is more effective to raise the flowing speed of the supplied ink, and hence to prevent air bubbles from remaining in the common ink chamber 22 or the like when the ink is filled or when the ink is sucked.

In the first embodiment, four end walls of the four pressure-chambers 12*b* communicating with the four nozzles 11*a* in the vicinity of the end of the row of the nozzles 11*a* on the side of the ink supplying ports 21*a* incline along an inclined line, so as to follow the jutting common ink chamber 22 and the jutting thin-part 17. However, this condition is not essential in the embodiment.

According to the above embodiment, because of the shape of the common ink chamber 22, the inertance of an ink flowing-path system communicating with a nozzle 11*a* in the vicinity of the end of the row of the nozzles 11*a* tends to become larger. However, since the pressure-chambers 12*b* communicating with the nozzles 11*a* in the vicinity of the end of the row of the nozzles 11*a* are shorter and the ink supplying ports 21 are arranged at the positions corresponding to the lengths of the pressure-chambers 12*b*, the above tendency is canceled. That is, the frequency response characteristic of a nozzle 11*a* in the vicinity of the end of the row of the nozzles 11*a* and the frequency response characteristic of another nozzle 11*a* away from the end of the row can coincide with each other.

Next, a second embodiment of the invention is explained with reference to FIG. 7.

Figure 7:
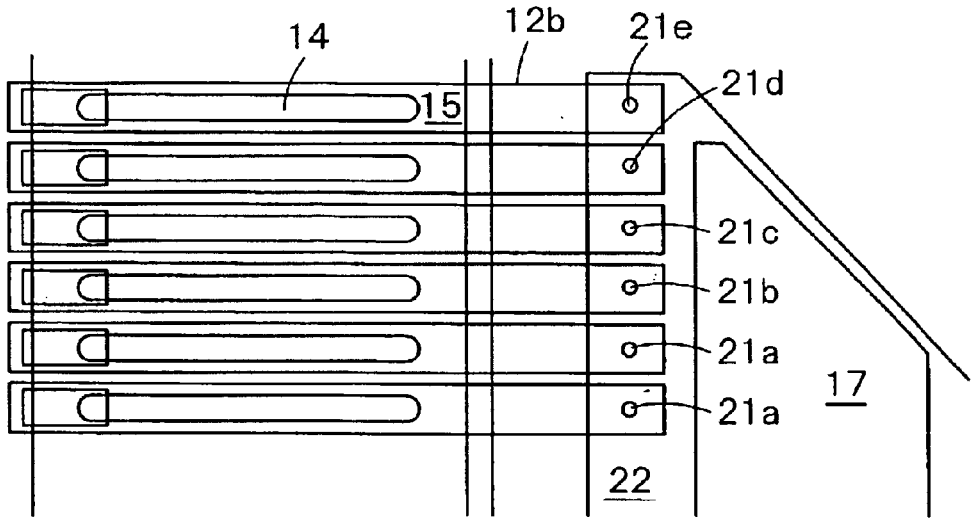
FIG. 7 is a schematic plan view of an ink-jetting recording head of a second embodiment according to the invention.

In the second embodiment shown in FIG. 7, similarly to the first embodiment, the common ink chamber 22 has a shape tapered toward the end of the line segment on which the plurality of nozzles 11*a* are aligned.

The common ink chamber 22 of the second embodiment doesn't jut out toward the nozzles 11*a*, even in any area in the vicinity of the end of the row of the nozzles 11*a*. In addition, the thin-part 17 of the common ink chamber 22 also doesn't jut out toward the nozzles 11*a*, even in any area in the vicinity of the end of the row of the nozzles 11*a*. However, in a tapered area of the common ink chamber 22, a substantial sectional area of the ink flowing-path is still smaller. Thus, the inertance of an ink flowing-path system communicating with a nozzle 11*a* in the vicinity of the end of the row of the nozzles (line segment) is larger. Therefore, there is a possibility that the characteristic of a nozzle 11*a* in the vicinity of the end of the line segment and the characteristic of another nozzle 11*a* away from the end (both ends) of the line segment might be different.

In addition, in the second embodiment, the pressure-chambers 12*b* have the same length. In the second embodiment, the diameters of ink supplying ports are changed to adjust the inertance of ink flowing-path systems.

That is, according to the embodiment, several (at least one) ink supplying ports communicating with several (at least one) nozzles 11*a* in the vicinity of the end of the line segment are formed so as to have larger diameters than an ink supplying port communicating with a central nozzle 11*a* away from the end (both ends) of the line segment.

Specifically, as shown in FIG. 7, the respective diameters of four ink supplying ports 21*b* to 21*e* communicating with four nozzles 11*a* in the vicinity of the end of the line segment are gradually larger in order toward the end of the row of the nozzles 11*a* (line segment).

More specifically, pressure-chambers 12*b* communicating with nozzles 11*a* in a central portion of the row of the nozzles 11*a* have a length of about 1.4 mm, a depth of about 0.1 mm, and a width of about 0.11 mm. Ink supplying ports 21*a* communicating with the nozzles 11*a* in the central portion of the row of the nozzles 11*a* have a diameter of 26.0 μm. The ink supplying port 21*e* communicating with the nozzle 11*a* in the close vicinity of (located at) the end of the row of the nozzles 11*a* has a diameter of 29.0 μm. The ink supplying port 21*d* communicating with the nozzle 11*a* in the second close vicinity of the end of the row of the nozzles 11*a* has a diameter of 28.0 μm. The ink supplying port 21*c* communicating with the nozzle 11*a* in the third close vicinity of the end of the row of the nozzles 11*a* has a diameter of 27.4 μm. The ink supplying port 21*b* communicating with the nozzle 11*a* in the fourth close vicinity of the end of the row of the nozzles 11*a* has a diameter of 26.7 μm. The center positions of the ink supplying ports 21*a* to 21*e* are aligned in parallel with the row of the nozzles 11*a*.

Other structure of the second embodiment is substantially the same as the first embodiment explained with reference to FIGS. 5 and 6. In the second embodiment, the same numeral references correspond to the same elements as the first embodiment. The explanation of the same elements is not repeated.

In the above embodiment too, because of the tapered shape of the common ink chamber 22, the inertance of an ink flowing-path system communicating with a nozzle 11*a* in the vicinity of the end of the row of the nozzles 11*a* tends to become larger. However, since the ink supplying ports 21*b* to 21*e* communicating with the nozzles 11*a* in the vicinity of the end of the row of the nozzles 11*a* have the larger diameters, the above tendency is canceled. That is, the frequency response characteristic of a nozzle 11*a* in the vicinity of the end of the row of the nozzles 11*a* and the frequency response characteristic of another nozzle 11*a* away from the end of the row can coincide with each other.

Next, a third embodiment of the invention is explained with reference to FIG. 8.

Figure 8:
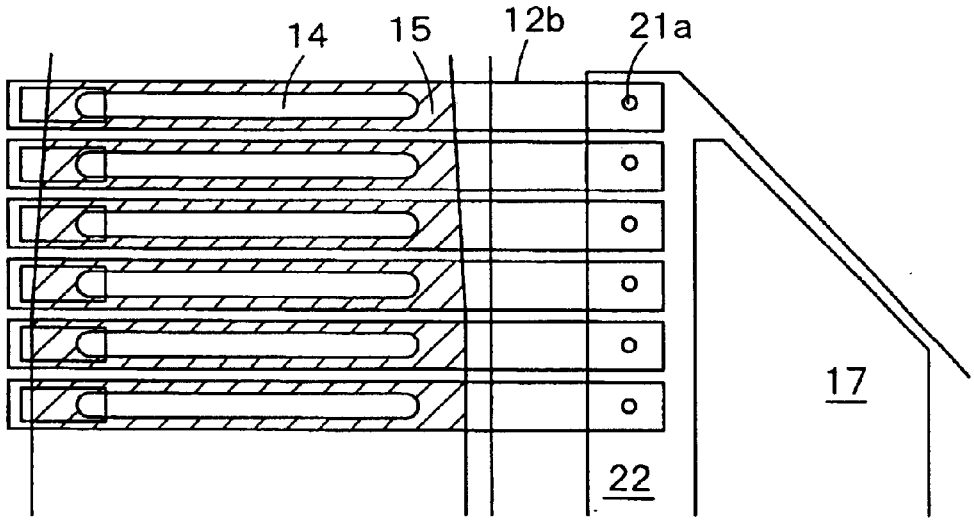
FIG. 8 is a schematic plan view of an ink-jetting recording head of a third embodiment according to the invention.

In the third embodiment shown in FIG. 8, similarly to the first embodiment, the common ink chamber 22 has a shape tapered toward the end of the line segment on which the plurality of nozzles 11*a* are aligned.

The common ink chamber 22 of the third embodiment doesn't jut out toward the nozzles 11*a*, even in any area in the vicinity of the end of the row of the nozzles 11*a*. In addition, the thin-part 17 of the common ink chamber 22 also doesn't jut out toward the nozzles 11*a*, even in any area in the vicinity of the end of the row of the nozzles 11*a*. However, in a tapered area of the common ink chamber 22, a substantial sectional area of the ink flowing-path is still smaller. Thus, the inertance of an ink flowing-path system communicating with a nozzle 11*a* in the vicinity of the end of the row of the nozzles (line segment) is larger. Therefore, there is a possibility that the characteristic of a nozzle 11*a* in the vicinity of the end of the line segment and the characteristic of another nozzle 11*a* away from the end (both ends) of the line segment might be different.

In addition, in the third embodiment, the pressure-chambers 12*b* have the same length. In the third embodiment, the areas of thin-parts 15, in particular the lengths of thin-parts 15, are changed to cancel the difference (tendency) of the inertance of ink flowing-path systems.

That is, according to the embodiment, several (at least one) thin-parts 15 corresponding to several (at least one) pressure-chambers 12*b* communicating with several (at least one) nozzles 11*a* in the vicinity of the end of the line segment are formed so as to have smaller areas than a thin-part 15 corresponding to a pressure-chamber 12*b* communicating with a central nozzle 11*a* away from the end (both ends) of the line segment. In detail, the several thin-parts 15 corresponding to several pressure-chambers 12*b* communicating with several nozzles 11*a* in the vicinity of the end of the line segment are formed so as to have shorter lengths in longitudinal directions of the pressure-chambers 12*b* than the thin-part 15 corresponding to a pressure-chamber 12*b* communicating with a central nozzle 11*a* away from the end (both ends) of the line segment.

Specifically, as shown in FIG. 8, the respective lengths of four thin-parts 15 corresponding to four pressure-chambers 12*b* communicating with four nozzles 11*a* in the vicinity of the end of the line segment are gradually shorter in order toward the end of the row of the nozzles 11*a* (line segment).

In addition, as shown in FIG. 8, the four thin-parts 15 corresponding to the four pressure-chambers 12*b* communicating with the four nozzles 11*a* in the vicinity of the end of the line segment are defined by respective inclined lines both at an end portion thereof on the side of the nozzles 11*a* and at the other end portion thereof on the side of the ink supplying ports 21*a*. In this embodiment, the gradients of the two inclined lines are the same.

More specifically, pressure-chambers 12*b* communicating with nozzles 11*a* in a central portion of the row of the nozzles 11*a* have a length of about 1.4 mm, a depth of about 0.1 mm, and a width of about 0.11 mm. Thin-parts 15 corresponding to the pressure-chambers 12*b* communicating with the nozzles 11*a* in the central portion of the row of the nozzles 11*a* have a length (standard length) of 85 $\mu$m. The length of the thin-part 15 corresponding to the pressure-chamber 12*b* communicating with the nozzle 11*a* in the close vicinity of (located at) the end of the row of the nozzles 11*a* is shorter at each end by 5 $\mu$m (totally by 10 $\mu$m) than the above standard length. The length of the thin-part 15 corresponding to the pressure-chamber 12*b* communicating with the nozzle 11*a* in the second close vicinity of the end of the row of the nozzles 11*a* is shorter at each end by 4 $\mu$m (totally by 8 $\mu$m) than the above standard length. The length of the thin-part 15 corresponding to the pressure-chamber 12*b* communicating with the nozzle 11*a* in the third close vicinity of the end of the row of the nozzles 11*a* is shorter at each end by 3 $\mu$m (totally by 6 $\mu$m) than the above standard length. The length of the thin-part 15 corresponding to the pressure-chamber 12*b* communicating with the nozzle 11*a* in the fourth close vicinity of the end of the row of the nozzles 11*a* is shorter at each end by 2 $\mu$m (totally by 4 $\mu$m) than the above standard length. The above lengths of the thin-parts 15 were measured at the centers of the respective thin-parts 15 in width directions thereof.

Other structure of the third embodiment is substantially the same as the first embodiment explained with reference to FIGS. 5 and 6. In the third embodiment, the same numeral references correspond to the same elements as the first embodiment. The explanation of the same elements is not repeated.

In the above embodiment too, because of the tapered shape of the common ink chamber 22, the inertance of an ink flowing-path system communicating with a nozzle 11*a* in the vicinity of the end of the row of the nozzles 11*a* tends to become larger. However, since the thin-parts 15 corresponding to the pressure-chambers 12*b* communicating with the nozzles 11*a* in the vicinity of the end of the row of the nozzles la have the shorter lengths (smaller areas), the acoustic capacitance cl of the pressure-chambers 12*b* can be directly adjusted to cancel the above tendency. That is, the frequency response characteristic (in particular, the natural period Tc) of a nozzle 11*a* in the vicinity of the end of the row of the nozzles 11*a* and the frequency response characteristic of another nozzle 11*a* away from the end of the row can coincide with each other (see the above expression (2)).

In addition, in the third embodiment, although the both end portions of the shorter thin-parts 15 are defined by the inclined lines, the way to shorten the thin-parts 15*b* is not limited. For example, when one-side end portions of the thin-parts 15 are aligned perpendicularly to the longitudinal directions of the pressure-chambers 12*b*, opposite-side end portions of the thin-parts 15 may be located stepwise.

Then, the method of working the above flowing-path plates 12 is explained.

The above flowing-path plates 12 are formed by: a first step of pressing a plurality of strip members with a tapered V-shaped section into a substrate partway in a thickness direction of the substrate so as to form a plurality of concave grooves as the plurality of pressure-chambers 12*b*; a second step of perforating each concave groove formed by the first step so as to form each nozzle-communicating chamber 12*a*; and a third step of forming a concave portion as the void 12*c*. The respective steps can be conducted by a press working.

After the first to third steps, the both surfaces of the flow-path plate 12 are grinded and made flat. Other specific matters of the method are disclosed in Japanese Patent Application 2001-396067 filed by the applicant.

When the flowing-path plate 12 is made from a metal plate by a press working, working cost of the head is low and durability of the head is superior.

Figure 9:
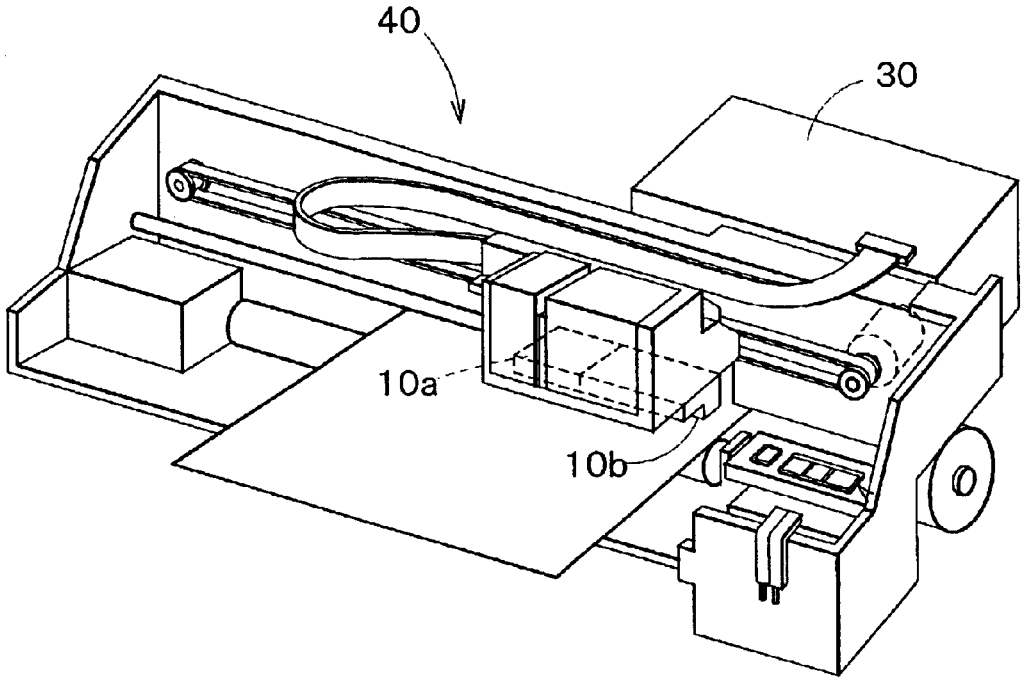
FIG. 9 is a schematic perspective view of an ink-jetting recording apparatus.
Figure 10:
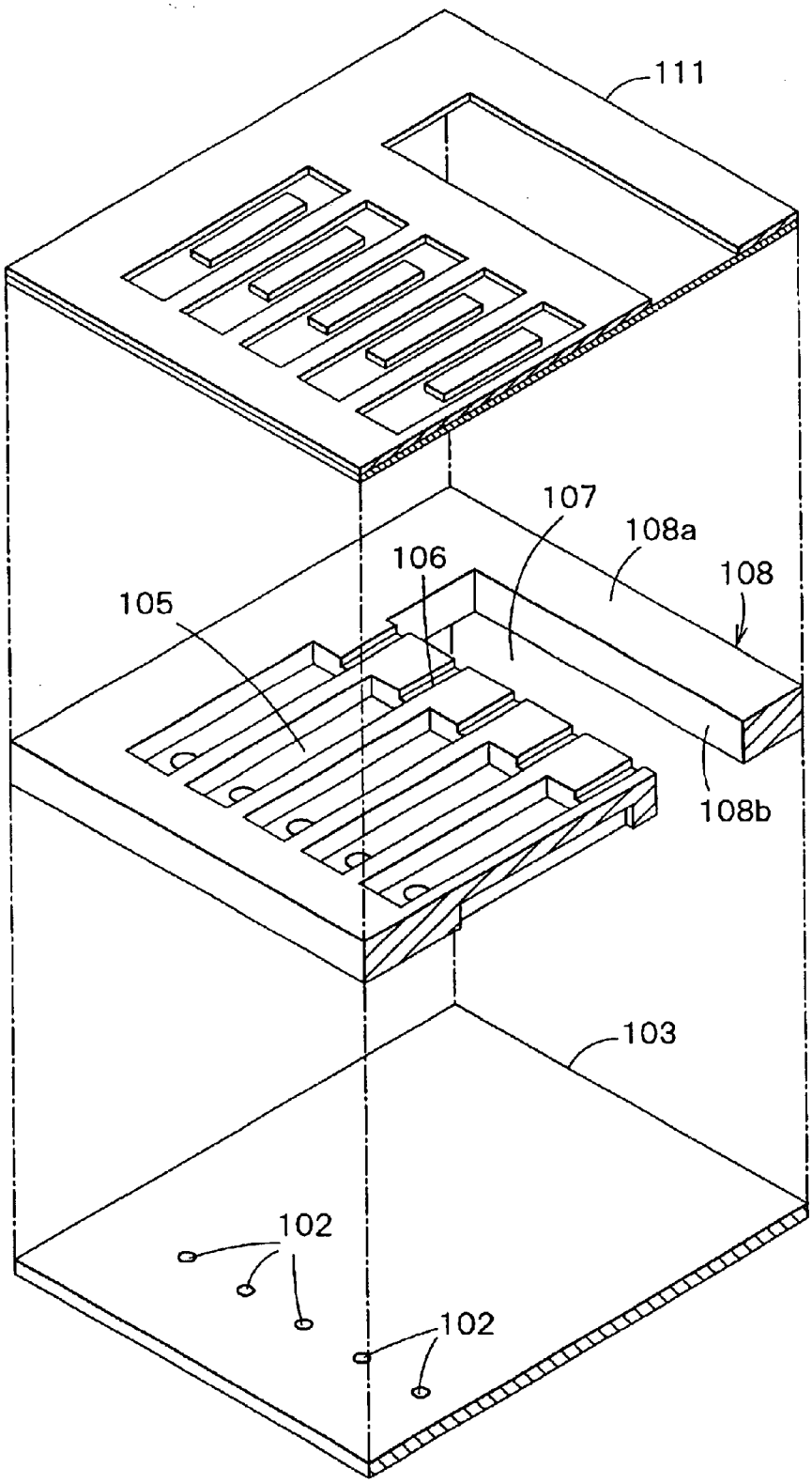
FIG. 10 is a schematic exploded view of an example of conventional ink-jetting recording head.

In addition, as shown in FIG. 9, the ink-jetting recording head 10 explained above may be combined with a controller

30 for controlling the laminated PZT 16 (pressure-generating units) to form an ink-jetting recording apparatus 40. In the case shown in FIG. 9, an ink-jetting recording head 10*a* for a black ink and an ink-jetting recording head 10*b* for color inks are arranged in parallel. The controller 30 can independently control the respective laminated PZT corresponding to the respective nozzles.

The above description is given for the ink-jetting recording heads. However, this invention is intended to apply to general liquid jetting heads widely. A liquid may be glue, bonding agent, nail polish, liquid metal for forming an electric circuit, or the like, instead of the ink. In addition, this invention can be also applied to a head for manufacturing color filters of a display member such as a liquid crystal display.

What is claimed is:

1. A liquid jetting head comprising:

a nozzle plate having a plurality of nozzles;

a flowing-path plate layered on the nozzle plate, the flowing-path plate having a plurality of nozzle-communicating chambers and a plurality of elongated pressure-chambers, the plurality of nozzle-communicating chambers respectively communicating with the plurality of nozzles, the plurality of pressure-chambers respectively communicating with the plurality of nozzle-communicating chambers, and the plurality of pressure-chambers being open to a side away from the nozzle plate;

a vibrating plate commonly sealing the open surfaces of the plurality of pressure-chambers of the plowing-path plate;

and a plurality of pressure-generating units that respectively change the pressures of liquids in the respective pressure-chambers;

wherein:

the plurality of nozzles are aligned on a line segment;

at least one of the pressure-chambers communicating with at least one of the nozzles in the vicinity of an end of the line segment is formed so as to have a shorter length than at least one of the pressure-chambers communicating with at least one of the nozzles away from the end of the line segment; and at least two of the pressure-chambers communicating with at least two of the nozzles in the vicinity of the end of the line segment are formed so as to have shorter lengths in order toward the end of the line segment.

2. A liquid jetting head according to claim 1, wherein: each of the pressure-chambers is formed in a direction substantially perpendicular to the line segment on which the plurality of nozzles are aligned.

3. A liquid jetting head according to claim 1, wherein: the vibrating plate has a plurality of supplying ports that respectively communicate with the plurality of pressure-chambers, and each of the supplying ports is arranged at a position that corresponds to a length of each of the pressure-chambers communicating with the supplying port.

4. A liquid jetting head according to claim 3, further comprising: a common-liquid-chamber member having a common liquid-chamber that commonly communicates with the plurality of supplying ports.

5. A liquid jetting head according to claim 4, wherein: the common liquid-chamber has a shape tapered toward the end of the line segment on which the plurality of nozzles are aligned.

6. A liquid jetting head according to claim 1, wherein:

the flowing-path plate consists of a metal plate capable of being processed by a press working.

7. A liquid jetting apparatus comprising; a liquid jetting head including:

a nozzle plate having a plurality of nozzles;

a flowing-path plate layered on the nozzle plate, the flowing-path plate having a plurality of nozzle-communicating chambers and a plurality of elongated pressure-chambers, the plurality of nozzle-communicating chambers respectively communicating with the plurality of nozzles, the plurality of pressure-chambers respectively communicating with the plurality of nozzle-communicating chambers, and the plurality of pressure-chambers being open to a side away from the nozzle plate;

a vibrating plate commonly sealing the open surfaces of the plurality of pressure-chambers of the flowing-path plate; and a plurality of pressure-generating units that respectively change the pressures of liquids in the respective pressure-chambers;

wherein:

the plurality of nozzles are aligned on a line segment, at least one of the pressure-chambers communicating with at least one of the nozzles in the vicinity of an end of the line segment is formed so as to have a shorter length than at least one of the pressure-chambers communicating with at least one of the nozzles away from the end of the line segment, and at least two of the pressure-chambers communicating with at least two of the nozzles in the vicinity of the end of the line segment are formed so as to have shorter lengths in order toward the end of the line segment; and a controller that respectively controls the plurality of pressure-generating units.

* * * * *